US007836731B2

(12) United States Patent
Lonati et al.

(10) Patent No.: US 7,836,731 B2
(45) Date of Patent: Nov. 23, 2010

(54) KNITTING MACHINE FOR HOSIERY OR THE LIKE WITH DEVICE FOR FEEDING THE YARN TO THE NEEDLES

(75) Inventors: Ettore Lonati, Botticino (IT); Tiberio Lonati, Brescia (IT); Fausto Lonati, Brescia (IT)

(73) Assignee: Santoni, S.p.A., Brescia (IT)

( * ) Notice: Subject to any disclaimer, the term of this patent is extended or adjusted under 35 U.S.C. 154(b) by 0 days.

(21) Appl. No.: 12/676,432

(22) PCT Filed: Aug. 28, 2008

(86) PCT No.: PCT/EP2008/061291

§ 371 (c)(1),
(2), (4) Date: Mar. 4, 2010

(87) PCT Pub. No.: WO2009/033958

PCT Pub. Date: Mar. 19, 2009

(65) Prior Publication Data

US 2010/0180641 A1 Jul. 22, 2010

(30) Foreign Application Priority Data

Sep. 11, 2007 (IT) ..... M12007A1742

(51) Int. Cl.
*D04B 15/58* (2006.01)

(52) U.S. Cl. ..... 66/133

(58) Field of Classification Search ..... 66/133, 66/125 R, 131, 136, 146, 125 B, 8
See application file for complete search history.

(56) References Cited

U.S. PATENT DOCUMENTS

| | | | | | |
|---|---|---|---|---|---|
| 4,391,105 | A | | 7/1983 | Lonati | |
| 5,046,333 | A | * | 9/1991 | Sawazaki et al. | 66/140 R |
| 5,056,339 | A | * | 10/1991 | Lonati | 66/134 |
| 5,237,841 | A | | 8/1993 | Lonati et al. | |
| 5,524,459 | A | * | 6/1996 | Beconcini | 66/136 |
| 5,964,106 | A | * | 10/1999 | Shibata et al. | 66/140 R |
| 6,000,245 | A | * | 12/1999 | Plath et al. | 66/139 |
| 6,109,069 | A | | 8/2000 | Sangiacomo | |

FOREIGN PATENT DOCUMENTS

| | | |
|---|---|---|
| DE | 30 33 039 A1 | 4/1981 |
| EP | 0 533 088 A2 | 3/1993 |
| GB | 2 343 200 A | 5/2000 |
| IT | MI20 010 585 A1 | 9/2002 |

* cited by examiner

*Primary Examiner*—Danny Worrell
(74) *Attorney, Agent, or Firm*—Scully, Scott, Murphy & Presser, P.C.

(57) ABSTRACT

A knitting machine for hosiery comprising a needle holder having a plurality of vertical slots accommodating each a needle movable along the corresponding slot in order to form knitting, and a device for feeding the yarn to the needles, arranged above the needle holder and supporting at least one elongated vertical yarn finger, its lower end being located proximate to the needle work area and having a passage for dispensing the yarn to be fed to the needles. The device comprises a supporting block arranged laterally and above the needle holder to support a rotatable intermediate element. The intermediate element supports, so that it can rotate a corresponding yarn finger.

11 Claims, 6 Drawing Sheets

KNITTING MACHINE FOR HOSIERY OR THE LIKE WITH DEVICE FOR FEEDING THE YARN TO THE NEEDLES

TECHNICAL FIELD

The present invention relates to a knitting machine for hosiery or the like with device for feeding the yarn to the needles.

BACKGROUND ART

As is known, the yarns needed to form knitting, in knitting machines for hosiery and the like, are supplied to the needles of the machine by way of suitable yarn fingers which are arranged laterally to the needle holder at a feed or drop of the machine.

At a feed or drop there are usually a plurality of yarn fingers, which can be actuated simultaneously or alternately so as to supply a plurality of yarns to the needles and/or vary the yarn or yarns supplied to the needles that pass at such feed or drop as a consequence of the motion of the needle holder with respect to the yarn fingers.

In many cases, each yarn finger is constituted substantially by an elongated body which is pivoted, with an intermediate portion of its longitudinal extension, to a supporting block and extends, with one of its ends, or yarn dispensing end, toward the needles arranged in the needle holder. The yarn finger can rotate on command, through an angle of preset breadth, about its own fulcrum with respect to the supporting block in order to pass from an inactive or off-work condition, in which it is spaced with its yarn dispensing end from the needles of the machine to prevent the needles, at the feed being considered, from being able to take the yarn dispensed by the yarn finger, to an active position, in which it is closer, with its yarn dispensing end, to the needles so that the needles, which are actuated at the feed being considered, can take the yarn to form new loops of knitting.

The need to be able to perform different types of knitting at a same feed or drop of the machine has highlighted the need to be able to have different positions for the dispensing end of the yarn fingers. Such different positions require, for the actuation of a yarn finger, the adoption of different actuators, which increase significantly the complexity of the yarn finger and of the elements designed to support and actuate it. Moreover, the presence of a plurality of actuators for the actuation of a yarn finger causes problems during design, since it is difficult to combine the requirements of space occupation imposed by the adoption of a plurality of actuators with the space available at a feed or drop of the machine.

In order to solve such problems, a device for feeding yarn to knitting machines for hosiery or the like has been proposed which is disclosed in Italian patent 1.325.202 by the same Applicant.

Such device comprises a supporting block, which can be associated with the machine laterally with respect to the needle holder and supports, for each yarn finger, an intermediate element which can rotate, with respect to the supporting block, about a first axis which is oriented substantially parallel to the tangent to the trajectory of the motion of the needle holder with respect to the supporting block. The intermediate element supports, so that it can rotate about a second axis which is substantially parallel and spaced with respect to the first axis, a corresponding elongated yarn finger, which is arranged substantially horizontally and protrudes from the block toward the needle holder. The yarn finger is pivoted, with an intermediate portion of its longitudinal extension, to the intermediate element about the second axis. By way of first and second actuation means, which act respectively on the intermediate element and on the yarn finger, causing their rotation through arcs of adjustable breadth, about the respective rotation axes, the position of the yarn dispensing end of the yarn finger is changed in order to meet the feed requirements of the needles during the several steps of the knitting of the machine.

Although this device has undeniable advantages in terms of versatility of use and precision in feeding the needles, as well as in terms of simplicity of construction and actuation, it suffers some drawbacks.

One of such drawbacks consists in that since the supporting block with the several yarn fingers faces the needle holder laterally, it conceals and hinders access to the work region of the needles, complicating the operations for threading the yarn in the yarn fingers and for adjusting the position of the yarn fingers with respect to the needles in machine tuning operations.

Another drawback consists in that the yarns, in their path from the inlet to the outlet of the feeder, undergo changes in direction with angles of considerable breadth, which increase the frictions that contrast the sliding of the yarns.

A further drawback, which arises from the arrangement of the supporting block and of the yarn fingers with respect to the supporting block, is constituted by the fact that it is not always possible to achieve optimum positioning of the yarn dispensing end of the several yarn fingers in relation to the position of the needles, particularly when a yarn finger is moved to an off-work position to interrupt the feed of the yarn to the needles.

DISCLOSURE OF THE INVENTION

The aim of the present invention is to provide a knitting machine for hosiery or the like with a device for feeding the yarn to the needles which, while ensuring optimum versatility in use and precision in feeding the needles, as well as great simplicity in manufacture and actuation, can obviate the drawbacks cited above.

Within this aim, an object of the invention is to allow better viewing and accessibility of the needle work area proximate to the device for feeding the yarn to the needles, simplifying and making less awkward the operations for threading the yarns and adjusting the position of the yarn fingers with respect to the needles during machine tuning operations.

Another object of the invention is to provide a machine with a device for feeding the yarn to the needles that simplifies in terms of actuation and improves the precision of the movement of the yarn fingers in their passage from a position for feeding the yarn to the needles to an inactive or off-work position, in which they prevent the grip of the yarn by the needles.

Another object of the invention is to provide a machine with a device for feeding the yarn to the needles which limits the redirections imposed to the yarns in their path within the device, so as to reduce the frictions that contrast the sliding of the yarns.

This aim and these and other objects, which will become better apparent hereinafter, are achieved by a knitting machine for hosiery or the like with a device for feeding yarn to the needles, comprising a needle holder which has a plurality of slots arranged side-by-side and substantially vertically, each slot accommodating a needle which can move on command along the corresponding slot in order to form knitting and a device for feeding the yarn to the needles which has at least one yarn finger which extends toward said needle holder; said needle holder being movable with respect to said device along a trajectory of motion, characterized in that said device comprises a supporting block, which is arranged laterally and above said needle holder and supports at least one elongated yarn finger, which is arranged substantially vertically, its lower end having a passage for dispensing the yarn to be fed to the needles; said supporting block supporting, for each yarn finger, an intermediate element, which rotates, with respect to said supporting block, about a first axis, which is oriented substantially parallel to the tangent to the path of the motion of said needle holder with respect to said supporting block; said intermediate element supporting, so that it can rotate about a second axis, which is substantially parallel and spaced with respect to said first axis, the corresponding yarn finger, which is pivoted to said intermediate element with an intermediate portion of its longitudinal extension about said second axis; first actuation means being provided which act on said intermediate element for its rotation about said first axis with respect to said supporting block, along an arc of adjustable breadth, in order to cause predominantly a movement of the lower end of the corresponding yarn finger along a substantially vertical direction, and second actuation means being provided which act on said yarn finger for its rotation about said second axis with respect to said intermediate element, through an arc of adjustable breadth, in order to cause predominantly a movement of the lower end of the yarn finger along a substantially horizontal direction.

BRIEF DESCRIPTION OF THE DRAWINGS

Further characteristics and advantages of the invention will become better apparent from the description of a preferred but not exclusive embodiment of the machine according to the invention, illustrated by way of non-limiting example in the accompanying drawings, wherein.

WAYS OF CARRYING OUT THE INVENTION

Figure 1:
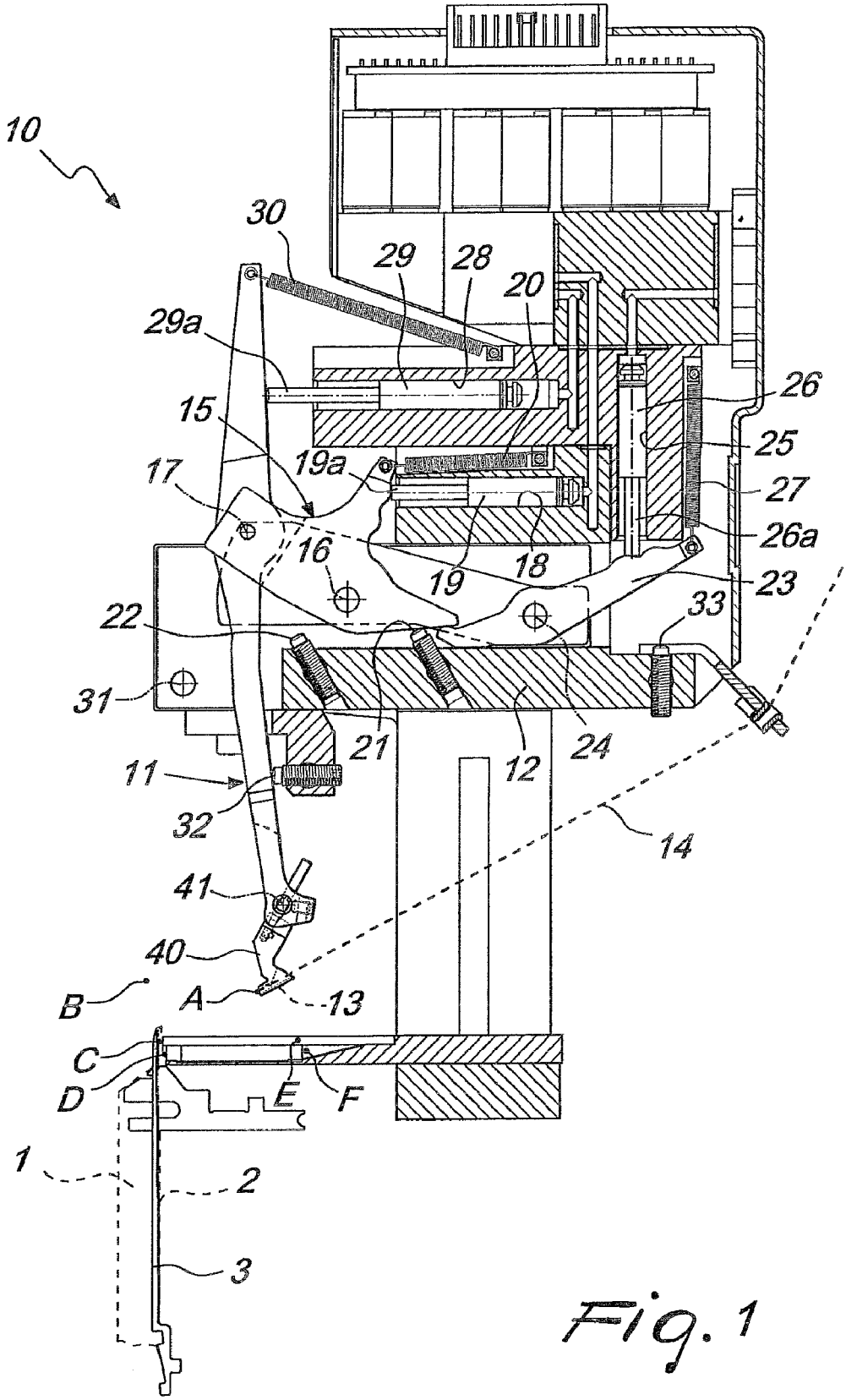
FIGS. 1 to 6 are schematic views of a portion of the machine with the device for feeding the yarn to the needles according to the invention in different operating conditions.

The embodiment shown in the figures refers to a circular knitting machine for hosiery or the like, but the concept on which the invention is based can be applied also to rectilinear machines, optionally varying the extent of the movements of the yarn finger in order to adapt them to the different shape of the needle holder.

With reference to the figures, the knitting machine for hosiery or the like according to the invention, of which only a reduced portion proximate to the needle work area has been shown schematically, comprises a needle holder 1, which has a plurality of slots 2, arranged side-by-side and inside each of which a needle 3 is accommodated which can move on command along the corresponding slot 2 in order to form knitting. The machine comprises a device for feeding the yarn to the needles, which is generally designated by the reference numeral 10 and is provided with at least one yarn finger 11, which extends towards the needle holder 1.

The needle holder 1 can move with respect to the device 10 in a per se known manner along a path of motion.

The machine according to the invention can be of the rectilinear or circular type. In this last case, which constitutes a preferred embodiment of the invention and corresponds to the machine shown in the figures, the needle holder 1 is constituted by the needle cylinder of the machine, which is arranged so that its axis is vertical and can be actuated with a rotary motion about such axis with respect to the device 10, which is fixed to the supporting structure of the machine.

The device 10 comprises a supporting block 12, which is arranged laterally and above the needle holder 1, preferably above the work area of the needles 3, and supports at least one elongated yarn finger 11 which is arranged substantially vertically, with its lower end arranged proximate to the work area of the needles 3 of the machine. Such lower end of the yarn finger 11 is provided with a dispensing passage 13 for a yarn 14 to be fed to the needles 3.

The supporting block 12 supports, for each yarn finger 11, an intermediate element 15, which is pivoted to the supporting block 12 about a first axis 16, which is oriented substantially parallel to the tangent to the path of motion of the needle holder 1 with respect to the supporting block 12.

The intermediate element 15 supports, so that it can rotate about a second axis 17, which is substantially parallel and spaced with respect to the first axis 16, the corresponding yarn finger 11, which is pivoted to the intermediate element 15, about the second axis 17, with an intermediate portion of its longitudinal extension.

The device 10 comprises first actuation means, which act on the intermediate element 15 in order to produce its rotation about the first axis 16 with respect to the supporting block 12, through an arc of adjustable breadth, in order to produce predominantly a movement of the lower end of the corresponding yarn finger along a substantially vertical direction, and second actuation means, which act on the yarn finger 11 in order to cause its rotation about the second axis 17 with respect to the intermediate element 15, through an arc of adjustable breadth, in order to cause predominantly a movement of the lower end of the yarn finger 11 along a substantially horizontal direction.

More particularly, the first actuation means comprise a first fluid-operated cylinder 18, which can be provided directly in the body of the supporting block 12, as shown, and is provided with a corresponding piston 19, which acts with its stem 19*a* on a portion of the intermediate element 15 that is spaced with respect to the first axis 16 so as to cause the rotation of the intermediate element 15 about the first axis 16 with respect to the supporting block 12 in contrast with first elastic means, constituted by a spring 20. The rotation arc of the intermediate element 15 about the first axis 16 is delimited by a first abutment 21 and by a second abutment 22, which are connected to the supporting block 12 and are spaced one another around the first axis 16.

Conveniently, means are provided for adjusting the position of the first abutment 21 and of the second abutment 22. More particularly, the abutments 21 and 22 are defined by the end of grub screws screwed into appropriately provided seats formed within the supporting block 12. The means for adjusting the position of the abutments 21 and 22 are constituted by the threaded coupling that exists between the grub screws that form the abutments 21 and 22 and the supporting block 12, which allows to position variously, according to the requirements, the abutments 21 and 22, so as to vary the breadth of the arc of possible rotation of the intermediate element 15 about the first axis 16.

The first actuation means, in addition to the first fluid-operated cylinder 18, comprise a lever 23, which is pivoted, with an intermediate portion thereof, to the supporting block 12 about a third axis 24, which is substantially parallel and spaced with respect to the axes 16 and 17. The lever 23 acts, with one of its ends, on the intermediate element 15 in order to cause its rotation about the first axis 16 with respect to the supporting block 12 in contrast with the first elastic means, which are constituted by the spring 20, through an arc of rotation which has a different breadth with respect to the breadth of the rotation arc delimited by the first abutment 21 and by the second abutment 22.

The lever 23 can rotate about the third axis 24 with respect to the supporting block 12 by way of the action of a second fluid-operated cylinder 25, which can also be provided in the body of the supporting block 12 and has a corresponding piston 26, which acts with its stem 26*a* on a portion of the lever 23 which is spaced from the third axis 24.

The lever 23 can turn on command about the third axis 24 with respect to the supporting block 12 by way of the action of the second fluid-operated cylinder 25 in order to pass from a deactivation position to an activation position in contrast with the action of elastic means constituted by a spring 27. In the deactivation position, the lever 23 does not interfere with the intermediate element 15, which in this manner can rotate by way of the action of the first fluid-operated cylinder 18 from a first position, in which it rests against the first abutment 21, to a second position, in which it rests against the second abutment 22. In the activation position, the lever 23, as an alternative to the actuation of the first fluid-operated cylinder 18, moves the intermediate element 15 into a third position, which is arranged between the first position and the second position cited above.

The activation position of the lever 23, which can be obtained by way of the actuation of the second fluid-operated cylinder 25, is delimited by means of adjusting its activation position constituted by a fifth abutment 33.

The second actuation means comprise a third fluid-operated cylinder 28, which can also be provided inside the body of the supporting block 12 and is provided with a corresponding piston 29, which acts with its stem 29*a* on a portion of the yarn finger 11 which is spaced with respect to the second axis 17 so as to be able to cause the rotation of the yarn finger 11 about the second axis 17, with respect to the intermediate element 15, in contrast with the action of second elastic means, constituted by a spring 30. The rotation arc of the yarn finger 11 with respect to the intermediate element 15 about the second axis 17 is delimited by a third abutment 31 and by a fourth abutment 32, which are connected to the supporting block 12 and are angularly spaced from each other about the second axis 17.

Conveniently, the abutments 21, 22, 33, 31 and 32 are positioned so that the outlet of the dispensing passage 13, formed in the lower end of the yarn finger 11, when the yarn finger 11 rests against the third abutment 31 or against the fourth abutment 32 and with the intermediate element 15 in the second position or in the third position cited above, faces the open side of the hook of the tip of the needles 3 that pass proximate to the supporting block 12, while when the yarn finger 11 rests against the third abutment 31 and the intermediate element 15 is in the first position, it lies above and to the rear with respect to the needles 3, i.e., moved on the side of the needles 3 that lies opposite the open side of the hook of the tip of the needles 3 that pass proximate to the supporting block 12.

Advantageously, the region of the yarn finger 11 that is designed to rest against the third abutment 31 is contoured and can engage slidingly the third abutment 31 so as to obtain for the yarn finger 11, which rests against the third abutment 31, a movement both along a vertical direction and along a horizontal direction, which allows the yarn finger 11 to move without interference, with its lower end, past the hook of the tip of the needles 3 that pass proximate to the supporting block 12 during the passage of the intermediate element 15 from the second position and from the third position to the first position or vice versa.

This particular sliding coupling between the yarn finger 11 and the third abutment 31 achieves a guided movement of the yarn finger 11, which makes the actuation of the yarn finger 11 particularly simple and allows to position the outlet of the dispensing passage 13 above and on the back of the needles 3, assuredly interrupting the feed of the needles 3 with the yarn 14.

For the fourth and fifth abutments 32 and 33 means are also provided for adjusting their position with respect to the supporting block 12. Such adjustment means can be constituted, in a manner which is similar to what has been described with reference to the abutments 21 and 22, by a threaded coupling between the supporting block 12 and grub screws which define the abutments 32 and 33.

The dispensing passage 13, which is formed at the lower end of the yarn finger 11, can be formed within a corresponding block 40, which is connected to the body of the yarn finger 11 with the possibility to adjust the position of the block 40 with respect to the body of the yarn finger both around an axis 41, which is substantially parallel to the axes 16, 17, 24, and transversely to such axis 41.

For the sake of completeness in description, it should be noted that the supporting block 12 of the device 10 preferably supports a plurality of yarn fingers 11 arranged side-by-side, each pivoted to a corresponding intermediate element 15, which can be actuated individually by means of corresponding fluid-operated cylinders, as described above, in order to allow the possibility to arrange a plurality of yarns to be fed to the needles of the machine.

Operation of the machine with the device for feeding yarns to the needles, as regards such device, is as follows.

In inactive conditions, which correspond to a position in which the yarn finger 11 is not used, shown in FIG. 1, only the fluid-operated cylinder 28 is actuated, while the fluid-operated cylinders 18 and 25 are deactivated. The intermediate element 15 is in its first position, resting against the first abutment 21 by way of the action of the spring 20, while the lever 23 is in the deactivation position. The yarn finger 11 rests against the fourth abutment 32 and the outlet of the dispensing passage 13 is located at the point A, which is spaced and raised with respect to the needles 3, on the open side of the hook of the tip of the needles 3, which pass proximate to the supporting block 12. In this position of the yarn finger 11, grip of the yarn 14 by the needles 3 is prevented.

Figure 2:
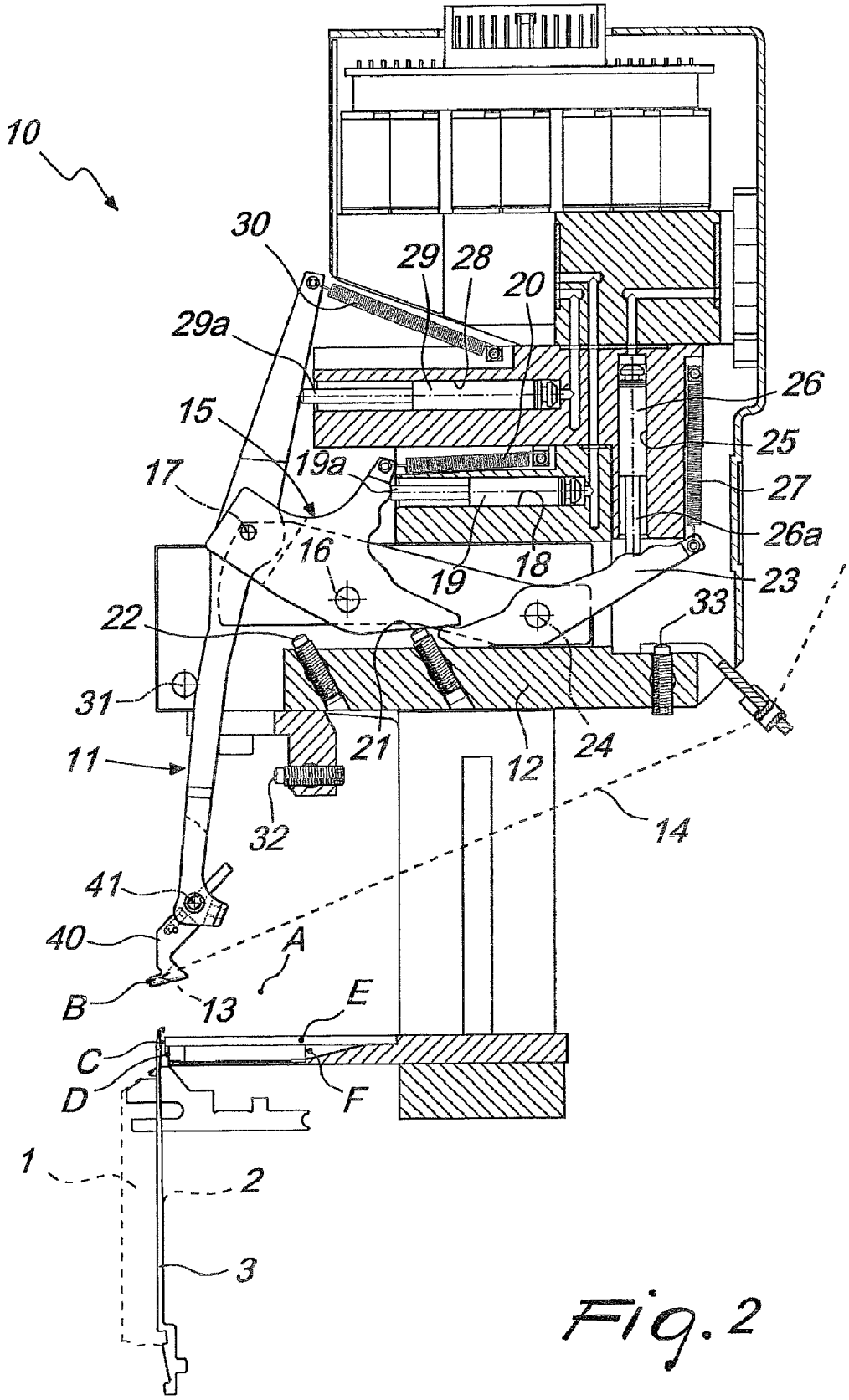

In the operating condition shown in FIG. 2, all the fluid-operated cylinders are deactivated. The intermediate element 15 is in its first position for resting against the first abutment 21 by way of the action of the spring 20, while the lever 23 is in the deactivation position. The yarn finger 11 rests against the third abutment 31 by way of the action of the spring 30, and the outlet of the dispensing passage 13 is at the point B, spaced and raised with respect to the needles 3, on the back of the needles 3, i.e., on the opposite side with respect to the open side of the hook of the tip of the needles 3, which transit proximate to the supporting block 12. In this operating condition, the outlet of the dispensing passage 13 is at the point B, safely excluding the possibility of grip of the yarn 14 by the needles 3 that follow previously fed needles. Substantially, this operating condition is used to move off-work the yarn finger 11, interrupting the feed of the yarn to the needles 3 of the machine.

The operating conditions shown in FIGS. 3 to 6 refer to operating positions of the yarn finger 11, i.e., to positions in which the yarn finger 11 is capable of feeding at least part of the needles 3 of the machine.

Figure 3:
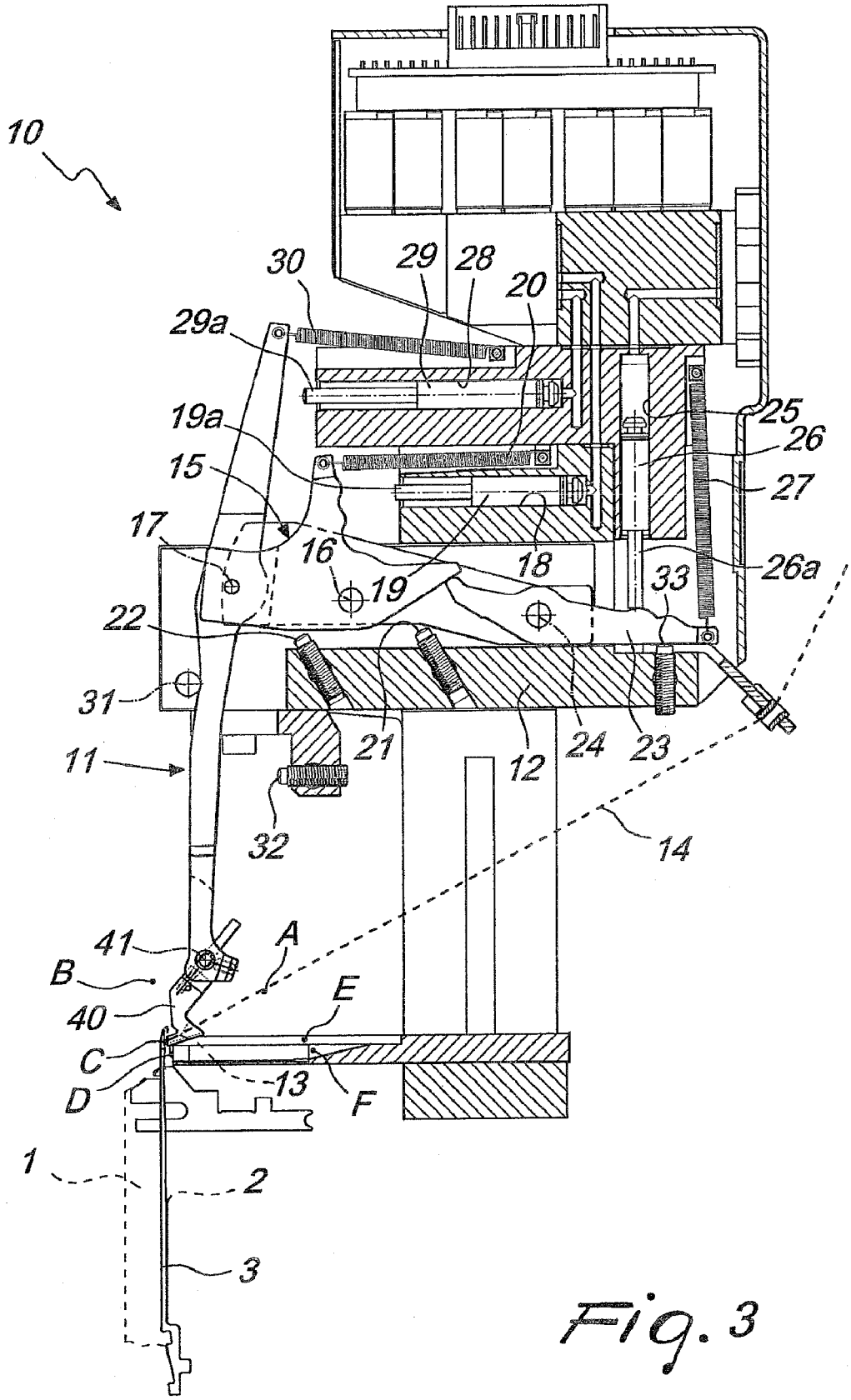

More particularly, FIG. 3 illustrates a third operating condition of the device, which is obtained by means of the actuation of the second fluid-operated cylinder 25, while the other fluid-operated cylinders are deactivated. The lever 23 is brought to the activation position, causing the passage of the intermediate element 15 to the third position. The yarn finger 11 rests against the third abutment 31 by way of the action of the spring 30, and the outlet of the dispensing passage 13 is located at the point C, which faces and is proximate to the open side of the hook of the tip of the needles 3 that pass proximate to the supporting block 12. In this position, the yarn finger 11 can allow the grip of the yarn 14 on the part of all the needles that are moved to knit or only of those needles that are moved to a level of height which is sufficient to engage the yarn 14 dispensed by the yarn finger 11.

Figure 4:
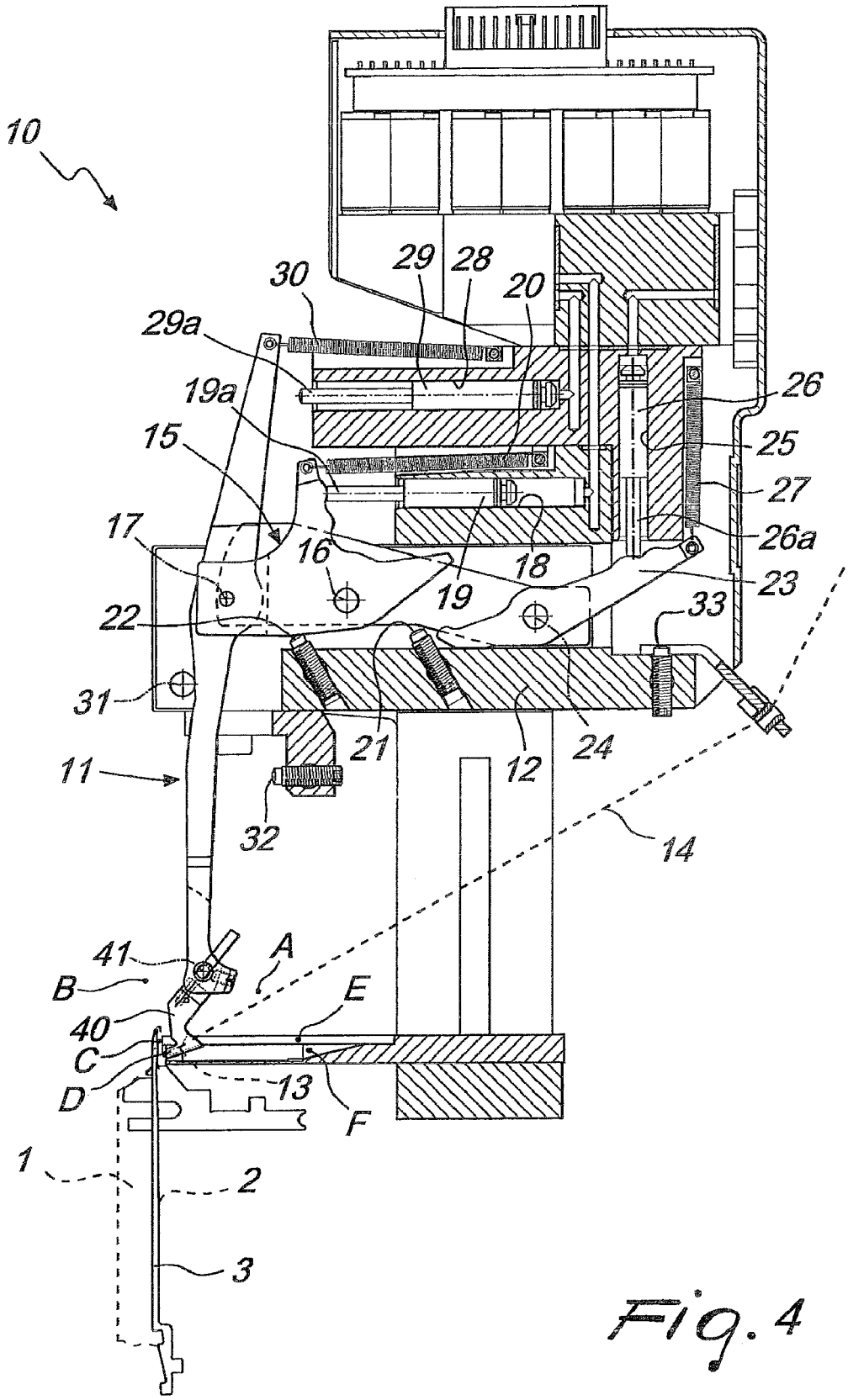

FIG. 4 illustrates a fourth operating condition of the device, which is achieved by means of the actuation of the first fluid-operated cylinder 18, while the other fluid-operated cylinders are deactivated. The lever 23 is in the deactivation position and the intermediate element 15 is in its second position for resting against the second abutment 22. The yarn finger 11 rests against the third abutment 31 by way of the action of the spring 30 and the outlet of the dispensing passage 13 is located at the point D, which faces and is close to the open side of the hook of the tip of the needles 3 that pass proximate to the supporting block 12. In this position, in which the outlet of the dispensing passage 13 is located at the point D, at a lower height level than the point C, the yarn finger 11 can allow the grip of the yarn 14 by all the needles or exclude the grip of the yarn by the needles that are moved with their open latch above the path of the yarn 14 dispensed by the dispensing passage 13 that is located, with its outlet, at the point D.

Figure 5:
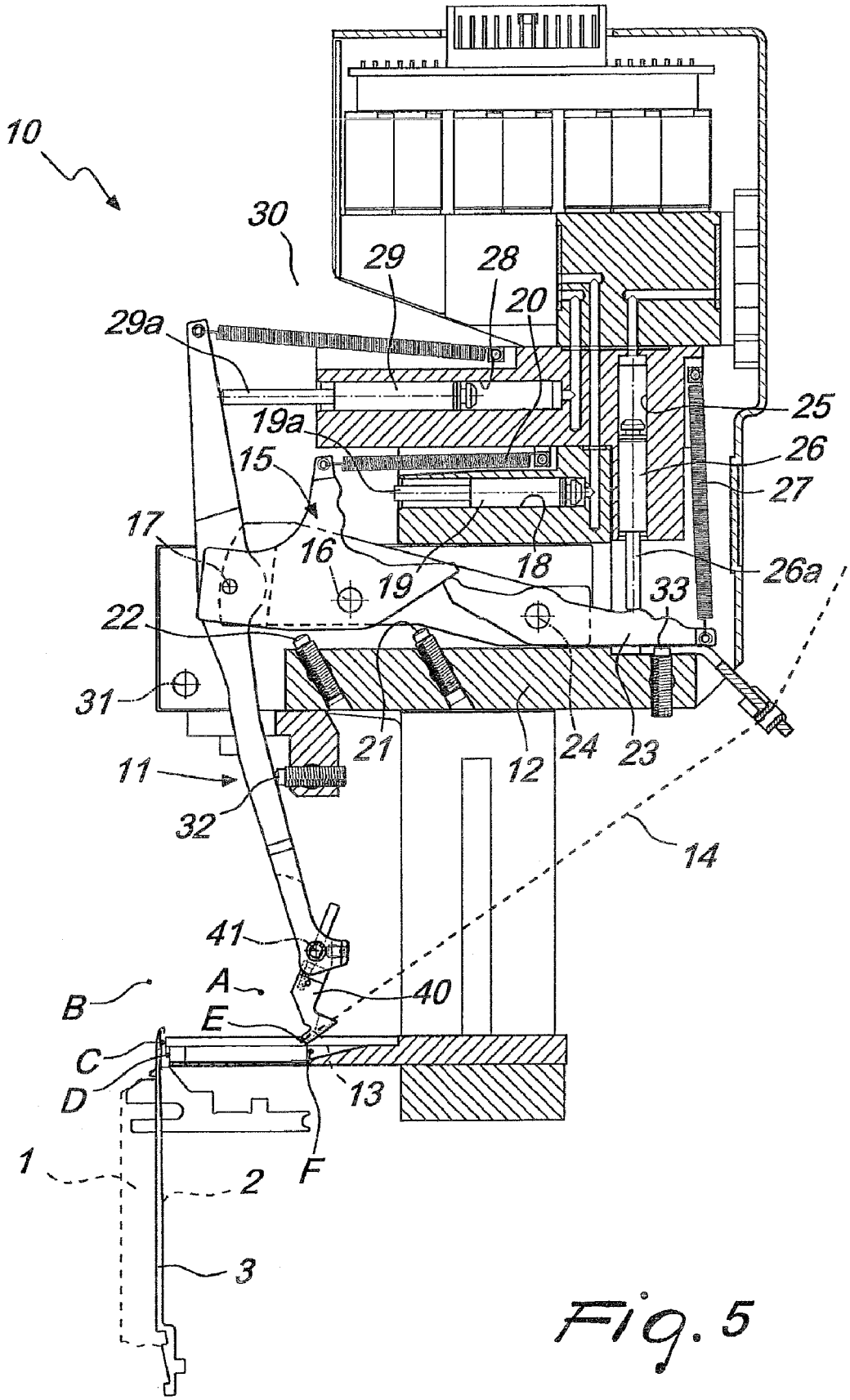

FIG. 5 illustrates a fifth operating condition of the device, which is obtained by means of the actuation of the second fluid-operated cylinder 25 and of the third fluid-operated cylinder 28, while the first fluid-operated cylinder 18 is deactivated. The lever 23 is moved into the activation position, causing the transition of the intermediate element 15 into the third position. The yarn finger 11 rests against the fourth abutment 32 and the outlet of the dispensing passage 13 is located at the point E, which is spaced with respect to the needles 3, on the open side of the hook of the tip of the needles 3, which pass proximate to the supporting block 12. In this position, the yarn finger 11 allows the needles 3 to grip the yarn 14.

Figure 6:
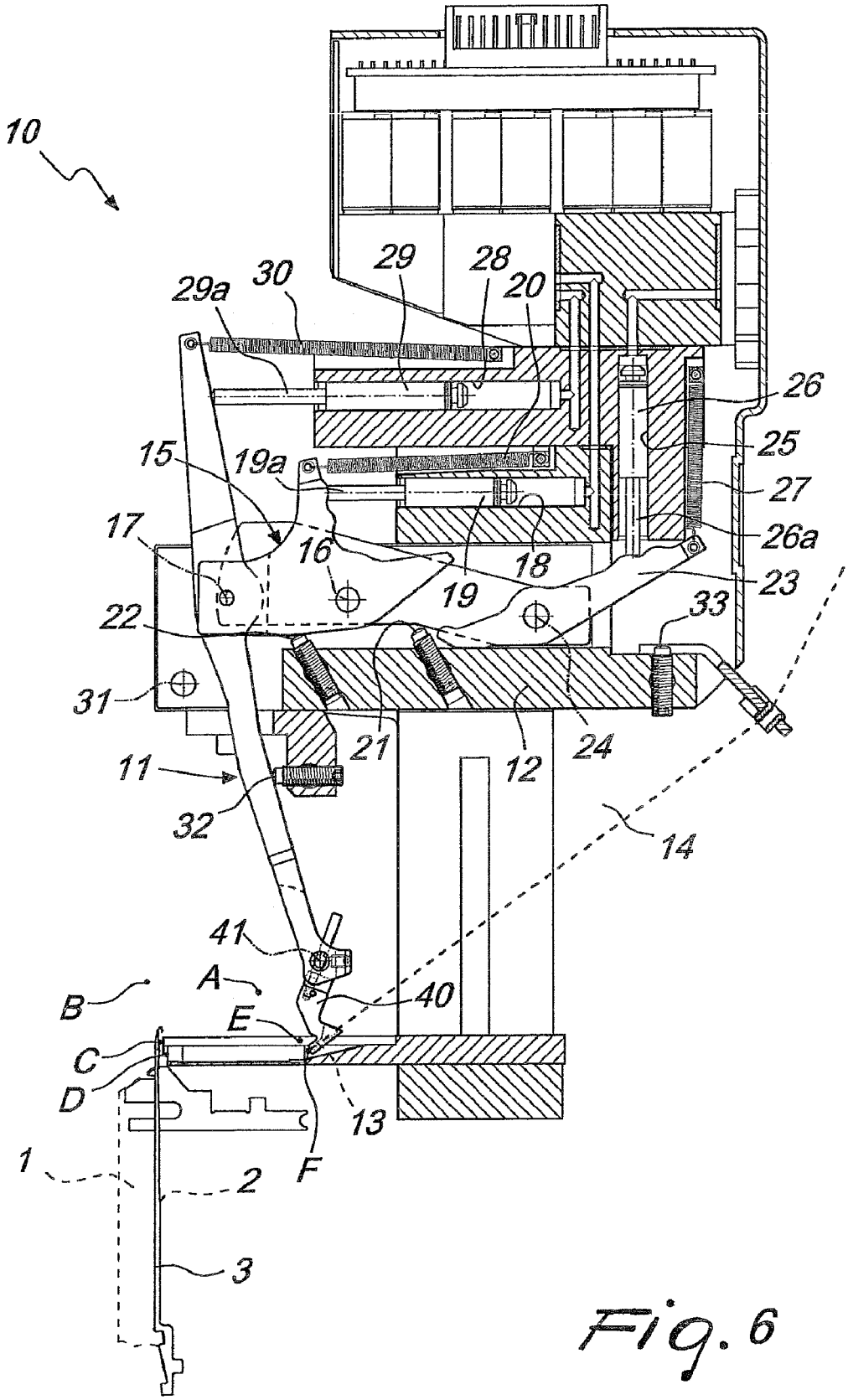

FIG. 6 illustrates a sixth operating condition of the device, which is achieved by means of the actuation of the first fluid-operated cylinder 18 and of the third fluid-operated cylinder 28, while the second fluid-operated cylinder 25 is deactivated. The lever 23 is kept in the deactivation position, while the intermediate element 15 is moved into the second position. The yarn finger 11 rests against the fourth abutment 32 and the outlet of the dispensing passage 13 is located at the point F, which is spaced with respect to the needles 3, on the open side of the hook of the tip of the needles 3, which pass proximate to the supporting block 12. In this position, the yarn finger 11 allows the needles 3 to grip the yarn 14.

For the sake of greater clarity, it should be noted that the end of the yarn 14 dispensed by the yarn finger 11 is usually clamped adjacent to the needle holder or even in a region of the needle holder that faces the back of the needles 3 and therefore, when the yarn finger 11 is moved into the positions shown in FIGS. 3 to 6, the portion of yarn 14 that extends from such end that is clamped to the outlet of the dispensing passage 13 can be engaged by the needles 3 that are moved to knit, so long as they are moved to a height level suitable for engagement. Once the feeding of the needles 3 has begun, the yarn 14 in output from the dispensing passage 13 extends from the last needle that engaged it to the outlet of the dispensing passage 13, allowing its engagement by the subsequent needles. In circular machines, this engagement is further assisted by the cylindrical shape of the needle holder.

The term "substantially", as used herein, is meant to indicate that the feature to which it refers is as defined but for tolerances which are known to the ones skilled in the art as normal for the technical field involved.

In practice it has been found that the knitting machine for hosiery or the like with device for feeding yarn to the needles according to the invention fully achieves the intended aim, since it ensures correct and precise feeding of the yarn to the needles, facilitating the yarn threading operations and the adjustment operations during the tuning of the machine and reducing frictions on the yarn during feeding.

Another advantage of the machine with the device for feeding yarn to the needles according to the invention is that it allows a high speed in the passage of the yarn finger to the off-work position, which allows to interrupt rapidly the feed of the needles to the advantage of the precision of the knitting that can be performed.

The machine thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application no. MI2007A001742, from which this application claims priority, are incorporated herein by reference.

The invention claimed is:

1. A knitting machine for hosiery with a device for feeding yarn to the needles, comprising a needle holder which has a plurality of slots arranged side-by-side and substantially vertically, each slot accommodating a needle which can move on command along the corresponding slot in order to form knitting and a device for feeding the yarn to the needles which has at least one yarn finger which extends toward said needle holder; said needle holder being movable with respect to said device along a path of motion, comprising a supporting block, which is arranged laterally and above said needle holder and supports at least one elongated yarn finger, which is arranged substantially vertically, its lower end having a passage for dispensing the yarn to be fed to the needles; said supporting block supporting, for each yarn finger, an intermediate element, which rotates, with respect to said supporting block, about a first axis, which is oriented substantially parallel to the tangent to the path of the motion of said needle holder with respect to said supporting block; said intermediate element supporting, so that it can rotate about a second axis, which is substantially parallel and spaced with respect to said first axis, the corresponding yarn finger, which is pivoted to said intermediate element with an intermediate portion of its longitudinal extension about said second axis; first actuation means being provided which act on said intermediate element for its rotation about said first axis with respect to said supporting block, along an arc of adjustable breadth, in order to cause predominantly a movement of the lower end of the corresponding yarn finger along a substantially vertical direction, and second actuation means being provided, which act on said yarn finger for its rotation about said second axis with respect to said intermediate element, through an arc of adjustable breadth, in order to cause predominantly a movement of the lower end of the yarn finger along a substantially horizontal direction.

2. The machine according to claim 1, comprising a first fluid-operated cylinder, which acts on command on said intermediate element for its rotation about said first axis with respect to said supporting block in contrast with first elastic means, the rotation arc of said intermediate element with respect to said supporting block about said first axis being delimited by a first abutment and by a second abutment, which are connected to said supporting block and are angularly spaced from each other around said first axis.

3. The machine according to claims 2, comprising a lever which is pivoted, with an intermediate portion thereof, to said supporting block and acts with one of its ends on said intermediate element for its rotation about said first axis with respect to said supporting block in contrast with said first elastic means along an arc of rotation of different breadth with respect to the breadth of the arc of rotation delimited by said first abutment and by said second abutment; said lever being able to rotate about its own fulcrum with respect to said supporting block by way of the action of a second fluid-operated cylinder which can be actuated on command.

4. The machine according to claim 3, wherein said lever can rotate on command about its own fulcrum with respect to said supporting block by way of the action of a second fluid-operated cylinder from a deactivation position, in which it does not interfere with said intermediate element, which can rotate by way of the action of said first fluid-operated cylinder from a first position, in which it rests against said first abutment, to a second position, in which it rests against said second abutment, to an activation position, in order to move said intermediate element into a third position, which is arranged between said first position and said second position.

5. The machine according to claim 4, wherein said second actuation means comprise a third fluid-operated cylinder, which acts on command on said yarn finger for its rotation about said second axis with respect to said intermediate element in contrast with second elastic means, the arc of rotation of said yarn finger with respect to said intermediate element about said second axis being delimited by a third abutment and by a fourth abutment, which are connected to said supporting block and are angularly spaced from each other around said second axis.

6. The machine according to claim 5, comprising means for adjusting the activation position of said lever.

7. The machine according to claim 5, wherein said means for adjusting the activation position of said lever are constituted by a fifth abutment, which is connected to said supporting block and delimits the rotation of said lever by way of the action of said second fluid-operated cylinder.

8. The machine according to claim 7, wherein said first to fifth abutments are arranged so that the outlet of said dispensing passage formed in the lower end of said yarn finger, when said yarn finger rests against said third abutment or against said fourth abutment and when said intermediate element is in said second position or in said third position, faces the open side of the hook of the tip of the needles that pass proximate to said supporting block, while when said yarn finger rests against said third abutment and said intermediate element is in said first position, it lies above and to the rear of the needles, i.e., shifted on the side of the needles that lies opposite with respect to the open side of the hook of the tip of the needles that pass proximate to said supporting block.

9. The machine according to claim 5, wherein the region of said yarn finger that is designed to rest against said third abutment is contoured and can engage slidingly said third abutment for a movement of the yarn finger, which rests against said third abutment, both along a vertical direction and along a horizontal direction in order to move without interference beyond the hook of the tip of the needles that pass proximate to said supporting block when said intermediate element passes from said second position or from said third position to said first position or vice versa.

10. The machine according to claim 7, comprising means for adjusting the position of at least part of said abutments with respect to said supporting block.

11. The machine according to claim 1, wherein it is constituted by a circular knitting machine for hosiery, said needle holder being constituted by the needle cylinder of the machine and said supporting block being arranged laterally to the needle cylinder above the needle work area.

* * * * *